US008726427B1

(12) United States Patent
Padron

(10) Patent No.: US 8,726,427 B1
(45) Date of Patent: May 20, 2014

(54) COMMODE FLUSHING HANDLE

(71) Applicant: Emigdio Padron, Fort Lauderdale, FL (US)

(72) Inventor: Emigdio Padron, Fort Lauderdale, FL (US)

( * ) Notice: Subject to any disclaimer, the term of this patent is extended or adjusted under 35 U.S.C. 154(b) by 0 days.

(21) Appl. No.: 13/687,171

(22) Filed: Nov. 28, 2012

(51) Int. Cl.
*A47K 13/10* (2006.01)
*E03D 5/08* (2006.01)

(52) U.S. Cl.
CPC .. *A47K 13/10* (2013.01); *E03D 5/08* (2013.01)
USPC ..... 4/246.3; 4/249

(58) Field of Classification Search
CPC ..... A47K 13/10; E03D 5/08; E03D 5/09
USPC ..... 4/249, 246.3
See application file for complete search history.

(56) References Cited

U.S. PATENT DOCUMENTS

| | | | | |
|---|---|---|---|---|
| 2,862,212 | A | 12/1958 | Holl | |
| 3,045,248 | A * | 7/1962 | Gentry | 4/249 |
| 3,416,161 | A * | 12/1968 | Perfater | 4/395 |
| 5,384,919 | A | 1/1995 | Smith | |
| 6,115,851 | A | 9/2000 | Maseruka | |
| 7,958,576 | B1 | 6/2011 | Johnson et al. | |

* cited by examiner

*Primary Examiner* — Tuan N Nguyen
(74) *Attorney, Agent, or Firm* — Crossley Patent Law; Micah C. Gunn

(57) ABSTRACT

A commode flushing handle that is attachable to a toilet wherein a horizontal rod section is rotatably disposed upon said toilet and a handle section is disposed endwise upon the rod section, said handle section disposed proximal the toilet bowl, whereby lifting the handle section depresses the flush handle of the toilet to flush the toilet without the user having to turn around or stand up from the toilet.

3 Claims, 4 Drawing Sheets

COMMODE FLUSHING HANDLE

BACKGROUND OF THE INVENTION

Various types of commode flushing handles are known in the prior art. However, what is needed is a commode flushing handle that is attachable to a toilet wherein a horizontal rod section is rotatably disposed upon said toilet and a handle section is disposed endwise upon the rod section, said handle section disposed proximal the toilet bowl, whereby lifting the handle section depresses the flush handle of the toilet to flush the toilet without the user having to turn around or stand up from the toilet.

FIELD OF THE INVENTION

The present invention relates to a commode flushing handle, and more particularly, to a commode flushing handle that is attachable to a toilet wherein a horizontal rod section is rotatably disposed upon said toilet and a handle section is disposed endwise upon the rod section, said handle section disposed proximal the toilet bowl, whereby lifting the handle section depresses the flush handle of the toilet to flush the toilet without the user having to turn around or stand up from the toilet.

SUMMARY OF THE INVENTION

The general purpose of the commode flushing handle, described subsequently in greater detail, is to provide a commode flushing handle which has many novel features that result in a commode flushing handle which is not anticipated, rendered obvious, suggested, or even implied by prior art, either alone or in combination thereof.

Many people suffer from decreased mobility, either as a result of age or injury. Some people are unable to readily stand up without assistance. For these and other people, flushing the toilet after use presents a real concern. What is needed is a commode flushing handle that is attachable to a toilet wherein a horizontal rod section is rotatably disposed upon said toilet and a handle section is disposed endwise upon the rod section, said handle section disposed proximal the toilet bowl, whereby lifting the handle section depresses the flush handle of the toilet to flush the toilet without the user having to turn around or stand up from the toilet.

The present commode flushing handle, therefore, includes a horizontally disposed cylindrical rod section. The rod section is disposed upon the toilet across a tangent proximal to the seat hinges. The rod section is disposed through the seat hinges and a plurality of locking collars disposed around the rod section releasably engages the rod section against each of the seat hinges to inhibit longitudinal movement of the rod section thereat. Each of the plurality of locking collars is releasably securable at a desired position along the length of the rod section by means of a set screw releasably engaging the locking collar to the rod section. Each of the plurality of locking collars is disposed on either side of a seat hinge, and the corresponding set screw is tightened to releasably secure the rod section in place.

The handle section attaches endwise to the rod section by means of a shaft member disposed endwise upon the rod section releasably inserting into a cavity disposed in an attachment section of the handle section. The shaft member is generally parallelepiped and the cavity has a square cross section. Thus, the flat surfaces of the shaft member engage with the surfaces disposed bounding the cavity, whereby rotational movement of the cavity is transferred to the rod section.

To ensure the shaft member remains in position within the cavity a set screw is disposed to releasably secure the shaft member within the cavity. The set screw inserts into the attachment section of the handle section and penetrates into the cavity. When the set screw is tightened, and the shaft member is disposed within the cavity, the set screw releasably engages against the shaft member to maintain the shaft member in position within the cavity.

A rightangular bend is disposed endwise upon the attachment section. The rightangular bend is contiguous with the attachment section, and an elongate arm is disposed in a plane generally perpendicular with the attachment section. The elongate arm is disposed extended proximal the side of the toilet bowl. A grip member is disposed endwise upon the elongate arm. When the elongate arm is raised, the attachment section rotates, and thus the rod section also rotates.

Disposed between the attachment section and the rod section is a bracket member. The bracket member is a flat member perpendicularly disposed between the rod section and the attachment section. The bracket member includes a square aperture configured to fit around the shaft member of the rod section. Thus the shaft member is inserted through the square aperture and into the cavity of the attachment section of the handle section. When releasably secured thereat by means of the set screw, the bracket member is secured between the rod section and the attachment section of the handle section.

Rotation of the rod section is translated to the bracket member. Thus, when the elongate arm is raised, the attachment section is rotated and also the rod section is rotated in a first direction, and the bracket member is lowered into a flush position. When the elongate arm of the handle section is again lowered, the attachment section and the rod section are rotated in a second direction and the bracket member is raised and returned to an initial position.

A cable member is disposed connected between the bracket member and the flush handle of the toilet. The cable member includes a first spring clip attached to the flush handle of the toilet. In the preferred embodiment herein disclosed, the first spring clip is attachable to the flush handle at a hole disposed through the flush handle. A cable section is disposed attached to the first spring clip extending downward to a turnbuckle adjustably disposed between the cable section and a second spring clip that releasably attaches to the bracket member. The turnbuckle enables adjustable sizing of the cable member to fit appropriately between the flush handle and the bracket member; the cable member is thusly adaptable to various makes and models of toilets.

Thus, when a person raises the elongate arm, and the bracket member is moved to the flush position, the cable member is pulled downward whereby the flush handle of the toilet is engaged and the toilet is flushed. Release of the elongate handle downward raises the bracket member to the initial position and the flush handle is enabled to return back to its pre-flush position. A person is thus enabled to readily flush a toilet without standing up from the toilet or contorting the torso to reach the flush handle while seated upon the toilet.

Thus has been broadly outlined the more important features of the present commode flushing handle so that the detailed description thereof that follows may be better understood and in order that the present contribution to the art may be better appreciated.

Objects of the present commode flushing handle, along with various novel features that characterize the invention are particularly pointed out in the claims forming a part of this disclosure. For better understanding of the commode flushing handle, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
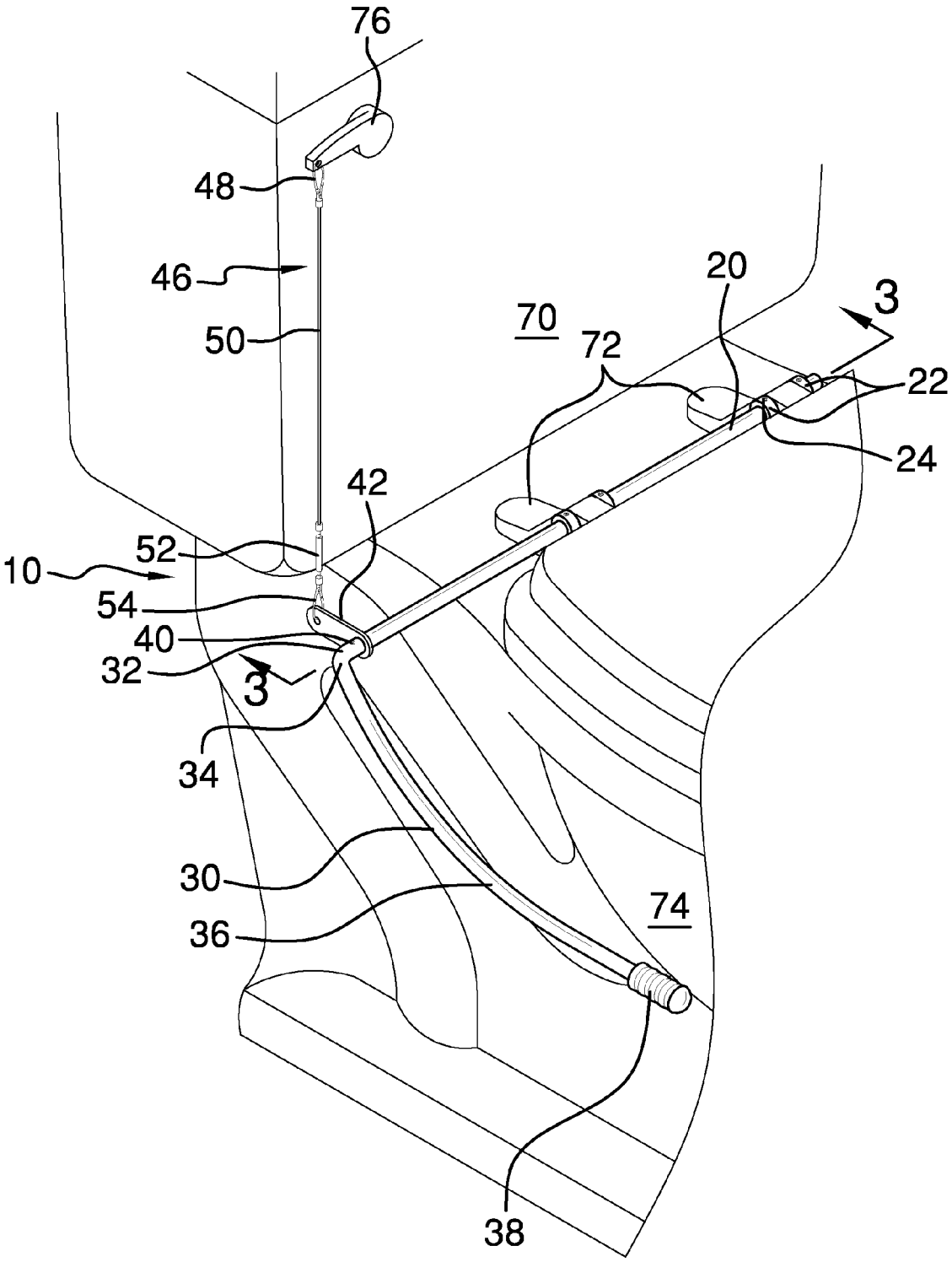
FIG. 1 is an isometric view.
Figure 2:
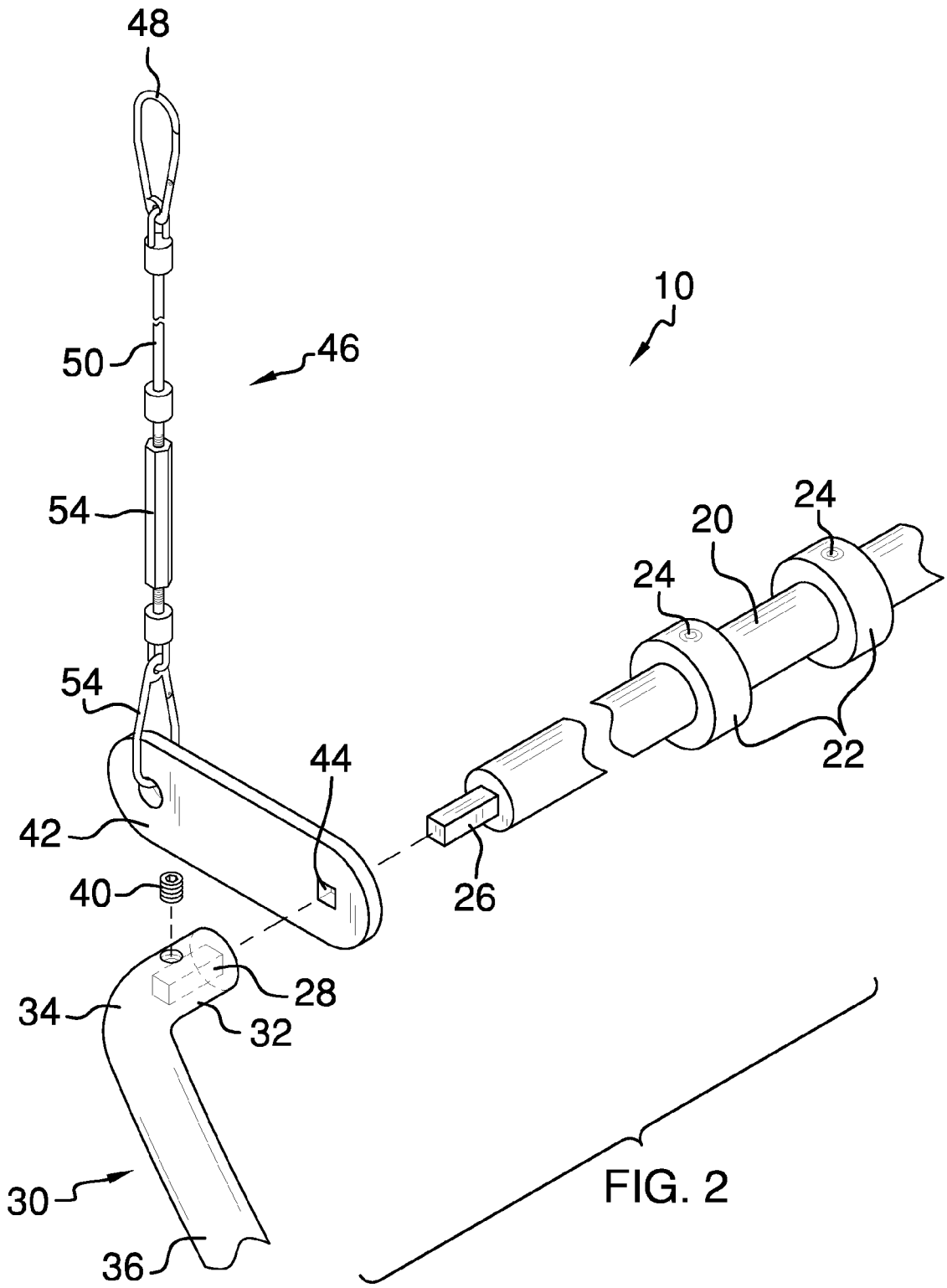
FIG. 2 is a detail view of a cable member, a bracket member, a rod section, and a handle section.
Figure 3:
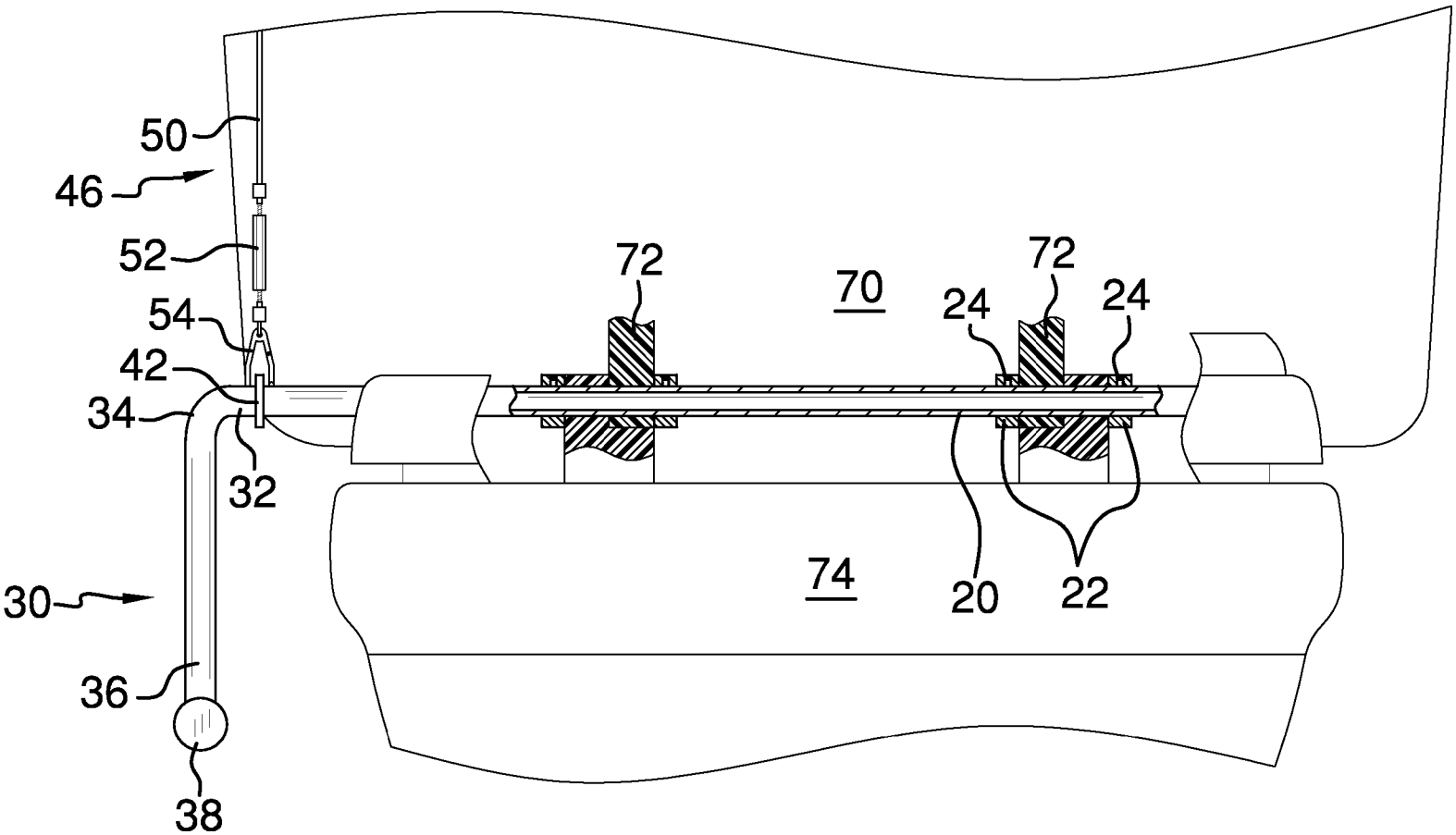
FIG. 3 is a front view.
Figure 5:
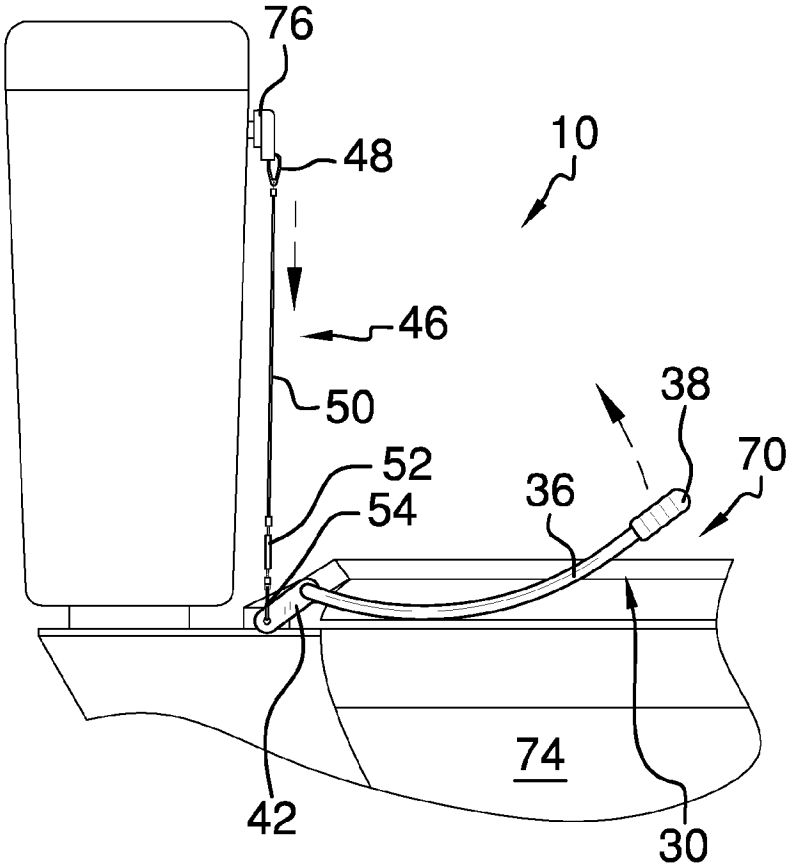
FIG. 5 is a side view with the handle section raised to flush the commode.
Figure 4:
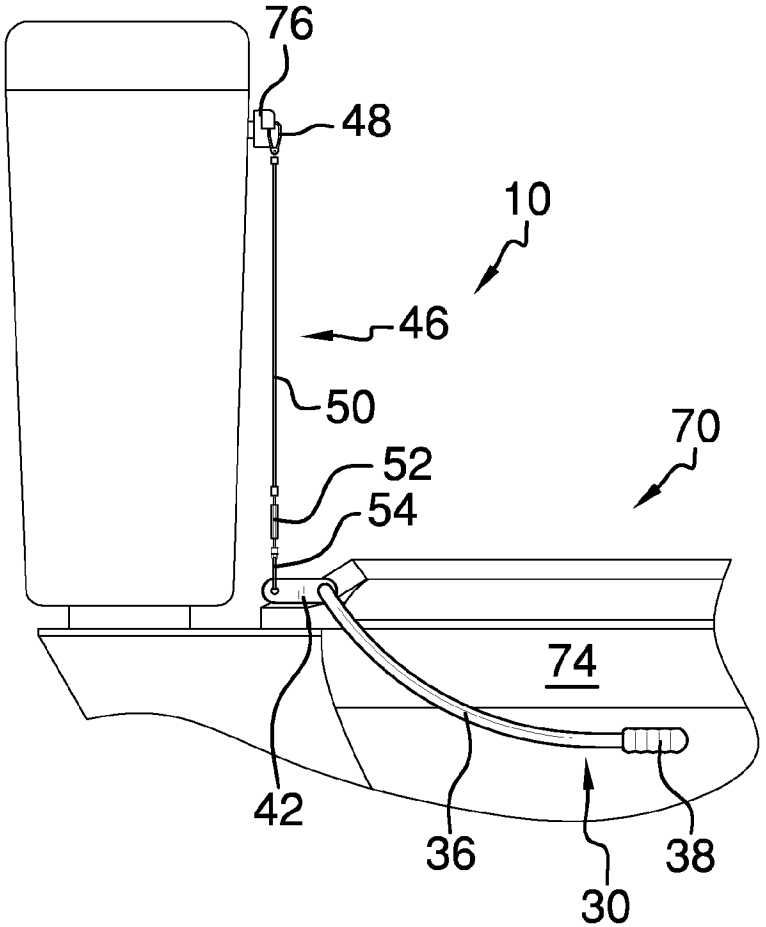
FIG. 4 is a side view.

With reference now to the drawings, and in particular FIGS. 1 through 4 thereof, an example of the instant commode flushing handle employing the principles and concepts of the present commode flushing handle and generally designated by the reference number 10 will be described.

Referring to FIGS. 1 through 4 a preferred embodiment of the present commode flushing handle 10 is illustrated.

The present device 10 has been devised to be installable on an extant commode to assist an individual with limited range of motion to flush the commode. A person is enabled to flush the commode 70 without rising or turning around. The present device 10 is installable to a commode 70 proximal the seat hinges 72 and interconnects the flush handle 76 with a rod section 20 whereby raising a handle section 30 pulls the flush handle 76 downward to effectively flush the commode 70 without the user having to stand or contort themselves upon the commode 70 to access the flush handle 76.

The commode flushing handle 10, then, includes a horizontally disposed cylindrical rod section 20 rotatably attached to a commode 70 proximal to the seat hinges 72. The rod section 20 includes a plurality of locking collars 22 disposed around the rod section 20, each of the plurality of locking collars 22 moveably positional along the rod section 20 and releasably securable at a desired position abutting each seat hinge 72 by means of a set screw 24 releasably engaging each of the plurality of locking collars 22 with the rod section 20. Each of the plurality of locking collars 22 thus prevents the rod section 20 from longitudinal movement whereby the rod section 20 is maintained in the desired position relative each of the seat hinges 72 until each of the set screws 24 is released and the rod section 20 enabled to move longitudinally thereby.

A parallelepiped shaft member 26 is disposed endwise upon the rod section 20. The parallelepiped shaft member 26 is configured to releasably insert into a cavity 28 disposed endwise in a handle section 30. The cavity 28 has a square cross section to releasably receive the shaft member 26 therein. The handle section 30 includes an attachment section 32, a rightangular bend 34, and an elongate arm 36 disposed approximately at right angles with respect to the attachment section 32 by means of the rightangular bend 34. The elongate arm 36 is extended proximal to the toilet bowl 74 of the commode 70 to be within easy reach of a person seated upon the commode 70. For ergonomic comfort, a grip member 38 is disposed endwise upon the elongate arm 36.

The cavity 28 has a square cross section to rotationally engage with the shaft member 26. A set screw 40 releasably secures the shaft member 26 within the cavity 28 to prevent release therefrom. Thus, lifting the handle section 30 rotates the rod section 20 in a first direction. Subsequent lowering of the handle section 30 therefore rotates the rod section 20 in a second direction.

A bracket member 42 is disposed upon the rod section 20, said bracket member 42 having a square aperture 44 through which the shaft member 26 inserts when interconnected with the handle section 30. Thusly, the bracket member 42 is fixedly secured between the rod section 20 and the handle section 30. When the handle section 30 is raised, and the rod section 20 is rotated in a first direction, the bracket member 42, engaged by the parallelepiped shaft member 26 within the square aperture 44, is moved from an initial position downward into a flush position. Subsequent lowering of the handle section 30 thusly raises the bracket member 42 back to the initial position.

A cable member 46 is disposed connected between the bracket member 42 and the commode 70 flush handle 76. The cable member 46 includes a first spring clip 48 connectable to the flush handle 76, a cable section 50 disposed connected to the first spring clip 48, an adjustable turnbuckle 52 disposed upon the cable section 50, and a second spring clip 54 disposed upon the turnbuckle 52, said second spring clip 54 attachable to the bracket member 42. The turnbuckle 52 enables length adjustment of the cable member 46 to fit the device 10 appropriate to various models of extant commodes.

Thus, raising the handle section 30 rotates the rod section 20 in a first direction, the bracket member 42 is lowered to the flush position, the cable member 46 is engaged to pull the flush handle 76 downward, and the commode is flushed without a user having to stand or turn around to access the flush handle 76 itself.

What is claimed is:

1. A commode flushing handle comprising:

a horizontally disposed rod section rotatably attachable to a commode proximal to the seat hinges;

a handle section disposed endwise on the rod section;

a bracket member disposed upon the rod section;

a cable member disposed connected between the bracket member and the flush handle, said cable member comprising:

a first spring clip connectable to the flush handle;

a cable section disposed connected to the first spring clip;

an adjustable turnbuckle disposed upon the cable section;

a second spring clip disposed upon the turnbuckle, said second spring clip attachable to the bracket member;

wherein pulling the handle section upward flushes the commode;

wherein the rod section further comprises:

a plurality of locking collars disposed around the rod section, each of the plurality of locking collars configured to abut one side of a seat hinge;

a shaft member configured to interconnect with the handle section;

a set screw disposed to releasably secure the shaft member within the handle section;

wherein the shaft member inserts through the bracket member and is releasably securable within the handle section.

2. The commode flushing handle of claim 1 wherein each of the plurality of locking collars is moveably positional along the rod section and releasably securable at a desired position abutting each seat hinge by means of a set screw releasably engaging each of the plurality of locking collars with the rod section.

3. A commode flushing handle comprising:

a horizontally disposed rod section rotatably attachable to a commode proximal to the seat hinges, said rod section comprising:

a plurality of locking collars disposed around the rod section, each of the plurality of locking collars moveably positional along the rod section and releasably securable at a desired position abutting one seat hinge by means of a set screw releasably engaging each of the plurality of locking collars with the rod section;

a parallelepiped shaft member disposed endwise upon the rod section;

a handle section interconnected with the shaft member of the rod section;

a cavity disposed endwise within the handle section, said cavity configured to releasably receive the shaft member therein;

a set screw releasably securing the shaft member within the handle section;

a bracket member disposed upon the rod section, said bracket member having an aperture through which the shaft member inserts when interconnected with the handle section whereby the bracket member is fixedly secured between the rod section and the handle section;

a cable member disposed connected between the bracket member and the flush handle, said cable member comprising:

a first spring clip connectable to the flush handle;

a cable section disposed connected to the first spring clip;

an adjustable turnbuckle disposed upon the cable section;

a second spring clip disposed upon the turnbuckle, said second spring clip attachable to the bracket member;

wherein pulling the handle section upward flushes the commode.

* * * * *